US009255419B2

(12) United States Patent
Stokes, Sr. et al.

(10) Patent No.: US 9,255,419 B2
(45) Date of Patent: Feb. 9, 2016

(54) CANTILEVER PARKING LIFT

(71) Applicants: Van Stokes, Sr., Delray Beach, FL (US); Van Stokes, Jr., Miami, FL (US)

(72) Inventors: Van Stokes, Sr., Delray Beach, FL (US); Van Stokes, Jr., Miami, FL (US)

( * ) Notice: Subject to any disclaimer, the term of this patent is extended or adjusted under 35 U.S.C. 154(b) by 115 days.

(21) Appl. No.: 13/947,408

(22) Filed: Jul. 22, 2013

(65) Prior Publication Data

US 2014/0027206 A1 Jan. 30, 2014

Related U.S. Application Data

(60) Provisional application No. 61/677,167, filed on Jul. 30, 2012.

(51) Int. Cl.

| | |
|---|---|
| ***E04H 6/18*** | (2006.01) |
| ***B66F 7/02*** | (2006.01) |
| ***B66F 7/04*** | (2006.01) |
| ***E04H 6/06*** | (2006.01) |

(52) U.S. Cl.
CPC *E04H 6/188* (2013.01); *B66F 7/02* (2013.01); *B66F 7/04* (2013.01); *E04H 6/06* (2013.01)

(58) Field of Classification Search
CPC ..... B66F 7/02; B66F 7/04; E04H 6/06; E04H 6/14; E04H 6/18; E04H 6/188
See application file for complete search history.

(56) References Cited

U.S. PATENT DOCUMENTS

| | | | | | |
|---|---|---|---|---|---|
| 1,710,442 | A * | 4/1929 | Warshaw | 187/262 |
| 2,139,597 | A * | 12/1938 | Martin | 187/213 |
| 3,172,501 | A * | 3/1965 | Ramer | 187/244 |
| 4,300,659 | A * | 11/1981 | Silverstrand | 187/213 |
| 4,674,938 | A * | 6/1987 | Van Stokes et al. | 414/228 |
| 5,119,906 | A * | 6/1992 | Kondratuk | 187/253 |
| 6,048,156 | A * | 4/2000 | Huang | 414/234 |
| 6,446,757 | B1 * | 9/2002 | Taylor | 187/208 |
| 6,550,584 | B1 * | 4/2003 | Granata | 187/213 |
| 6,695,533 | B1 * | 2/2004 | Bulmann | 405/3 |
| 7,066,683 | B2 * | 6/2006 | Way | 405/3 |
| 7,413,378 | B2 * | 8/2008 | Way | 405/4 |
| 8,297,410 | B2 * | 10/2012 | McDonald | 187/250 |
| 2009/0321189 | A1 * | 12/2009 | Schmitt | 187/215 |
| 2010/0089845 | A1 * | 4/2010 | Fassler et al. | 211/1.57 |

* cited by examiner

*Primary Examiner* — William E Dondero
*Assistant Examiner* — Minh Truong
(74) *Attorney, Agent, or Firm* — Timothy X. Gibson, Esq.

(57) ABSTRACT

A cantilever parking lift system having columns and a platform includes a lift mechanism employing a vertically movable dynamic cross chain sheave assembly positioned adjacent a column, a vertically movable static cross chain sheave assembly positioned adjacent a second column, a cross chain extending from the first base and functionally engaged with the dynamic cross chain sheave assembly and static cross chain sheave assembly and to a block assembly housed in a base, wherein the block assembly is movable along a length of the first base and operable to raise the dynamic cross chain sheave assembly, and wherein the cross chain extends beneath and transversely across the platform. An actuator is positionable in the base, rather than in or around the vertical column.

17 Claims, 13 Drawing Sheets

CANTILEVER PARKING LIFT

CROSS REFERENCE TO RELATED APPLICATIONS

This application claims the benefit of U.S. Provisional Patent Application Ser. No. 61/677,167, filed Jul. 30, 2012, the entirety of which is incorporated by reference herein.

FIELD OF THE INVENTION

The present invention relates to a parking lift apparatus and in particular to a cantilever parking lift apparatus for parking motor vehicles.

BACKGROUND OF THE INVENTION

Cantilever-type vehicle lifts typically employ a lift mechanism such as a hydraulic lift cylinder in or around a vertical column, which requires the vertical column to have undue width to accommodate the lift mechanism and results in the lifting mechanism and all the moving parts associated with it being in the area of the vertical column, which is undesirable. In addition, currently available cantilever lifts employ a raised edge on the platform that gives it longitudinal strength, but it is a tripping point and very awkward to walk around. Another drawback of most current cantilever designs that use a common column is that the sliding portion for each side is affixed to the column on that side of the column. The columns are generally made with a sliding area, if using plastic slides, or a rolling area if using rollers, on each side of the column. The front and back sliding areas are then connected together with a single center connection piece. The problem with this arrangement is that the force placed on the sliding area by the cantilevered load of the platform causes a twisting movement that pivots about the center connecting piece in the column. In addition, current cantilever lift devices do not allow the platform to sit flat on the ground in circumstances when the ground is sloped.

Thus, there is a need for a cantilever parking lift system that addresses these drawbacks.

SUMMARY OF THE INVENTION

In accordance with one embodiment a cantilever parking lift system is disclosed which employs an actuator, such as a hydraulic cylinder, in the foot, or base, rather than in or around the vertical column. This aspect permits the vertical column, or the lifting column, to be made very narrow because it has no actuator in or around it. It also keeps the actuator and all the moving parts associated with it covered and out-of-the-way. This arrangement permits the column to be completely assembled at the factory, including the mechanical, hydraulic and electrical components associated therewith, and to fully test its operational configuration before it is packaged and shipped. This makes the installation of the lift on-site much faster and simpler.

In one embodiment a cantilever parking lift system is provided which is operable to be positioned on a surface, the lift system including a vertically movable parking platform, first and second bases positionable on the surface, first and second columns extending vertically from the first and second bases, respectively, wherein the platform is positioned between the bases and columns, and a lift mechanism having a vertically movable dynamic cross chain sheave assembly positioned adjacent the first column, a vertically movable static cross chain sheave assembly positioned adjacent the second column, a cross chain extending from the first base and functionally engaged with the dynamic cross chain sheave assembly and static cross chain sheave assembly and anchored at one end proximate a top portion of the second column, a lifting chain extending from the dynamic cross chain sheave assembly to an upper direction changing sheave proximate a top portion of the first column and to a lower direction changing sheave proximate a bottom of the first column, and to a block assembly housed in the first base, wherein the block assembly is movable along a length of the first base and operable to raise the dynamic cross chain sheave assembly, and wherein the cross chain extends beneath and transversely across the platform. An actuator may be positioned in the first base and operably connected to the block assembly. The actuator may be for example a hydraulic cylinder.

In one embodiment the lifting chain may include a differential connected to a power chain extending from the block assembly.

In accordance with yet a further embodiment, a vertical column is provided with improved means for sliding the platform up and down, employing two center connecting pieces that line up the front and back sliding areas and eliminate any twisting connection. The means may include a first carriage side plate slidably engaged to the first column and a second carriage side plate slidably engaged to the second column.

In a further embodiment, the block assembly may have a multiplier sheave, a block chain anchor, a lower direction changing sheave and block sheave, wherein the lifting chain is anchored to the block chain anchor, fed around the multiplier sheave, block sheave and the lower direction changing sheave. The dynamic cross chain sheave assembly may include a sliding sheave assembly having a sheave including pins extending from sides of the sheave, and plates having slots for slidably retaining the pins. This cross chain adjusting device permits the platform to sit flat on the ground no matter which way the ground slopes from side to side.

The static cross chain sheave assembly may include a sheave and bracket operable to guide the cross chain as the dynamic cross chain sheave assembly rises and descends.

In accordance with another embodiment, an improved platform is provided which does not include a raised edge, so the platform is easier to walk on when entering and leaving the car. The curbs on the presently disclosed platforms are significantly wider than those of other lifts and are the same height as the top of the base, where the actuator is mounted, providing a flat surface to walk along. The wide curbs have a further advantage that they force the driver to center the car on the lift, which keeps down the damage caused by hitting the rearview mirrors or slamming the doors into the column. In one embodiment the curbs extend along opposite sides of the platform perpendicular to an entrance end of the platform. The curbs may be approximately 4 to about 10 inches in width, preferably approximately 6 to 7 inches in width, and most preferably 6.5 inches in width.

The platform may include a ridge extending transversely across the platform parallel to an entrance end of the platform.

The platform may further include a ramp proximate an entrance end thereof, the ramp having a front slope extending upward from the edge of the platform entrance and a rear slope extending downwardly toward an opposite end of the platform. The platform may have two entrance ends, one at each end of the platform.

In another embodiment, the lift system may include an adjacent platform and lift system. The lift system may include a second platform and a third base adjacent the second column on a side of the second column opposite the first platform, a further vertically movable dynamic cross chain sheave assembly positioned adjacent the second column, a further vertically movable static cross chain sheave assembly positioned adjacent the third column, a second cross chain extending from the second base and functionally engaged with the further dynamic cross chain sheave assembly and further static cross chain sheave assembly and anchored at one end proximate a top portion of the third column, a second lifting chain extending from the further dynamic cross chain sheave assembly to an upper direction changing sheave proximate a top portion of the second column and to a lower direction changing sheave proximate a bottom of the second column, and to a further block assembly housed in the third base, wherein the block assembly is movable along a length of the third base and operable to raise the further dynamic cross chain sheave assembly, and wherein the second cross chain extends beneath and transversely across the second platform. A further actuator, such as a hydraulic cylinder, may be positioned in the third base and operably connected to the further block assembly.

BRIEF DESCRIPTION OF THE DRAWINGS

These and other objects of the present invention will become apparent, particularly when taken in view of the following drawings wherein.

Figure 1:
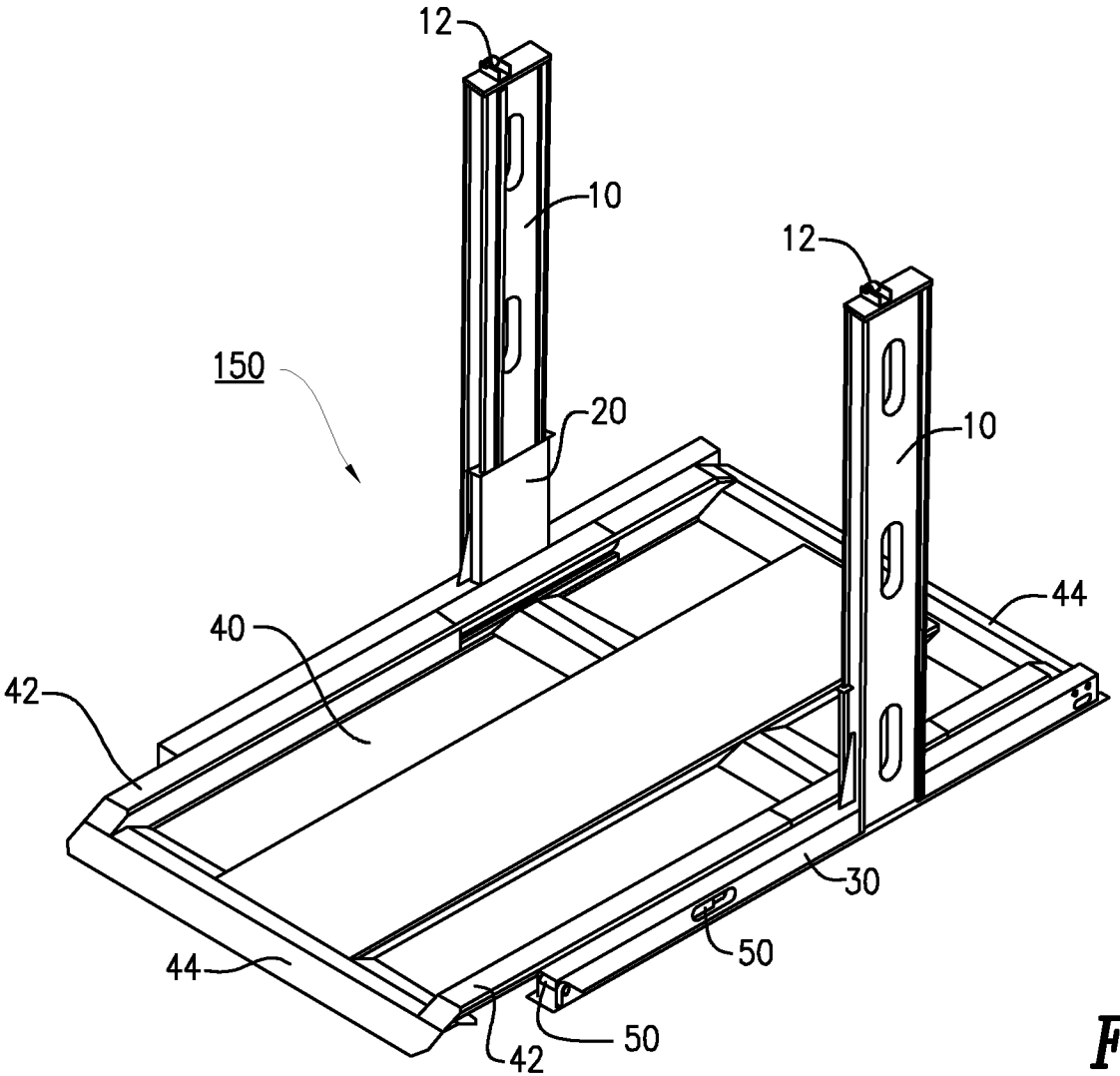
FIG. 1 depicts a perspective view of a cantilever parking lift assembly in accordance with one aspect of the disclosure.

For the purposes of illustration, there are forms shown in the drawings that are presently preferred, it being understood, however, that the invention is not limited to the precise arrangements and instrumentalities shown.

DETAILED DESCRIPTION OF EMBODIMENTS OF THE INVENTION

In the following description, for purposes of explanation, specific numbers, materials and configurations are set forth in order to provide a thorough understanding of the invention. It will be apparent, however, to one having ordinary skill in the art that the invention may be practiced without these specific details. In some instances, well-known features may be omitted or simplified so as not to obscure the present invention.

Figure 2:
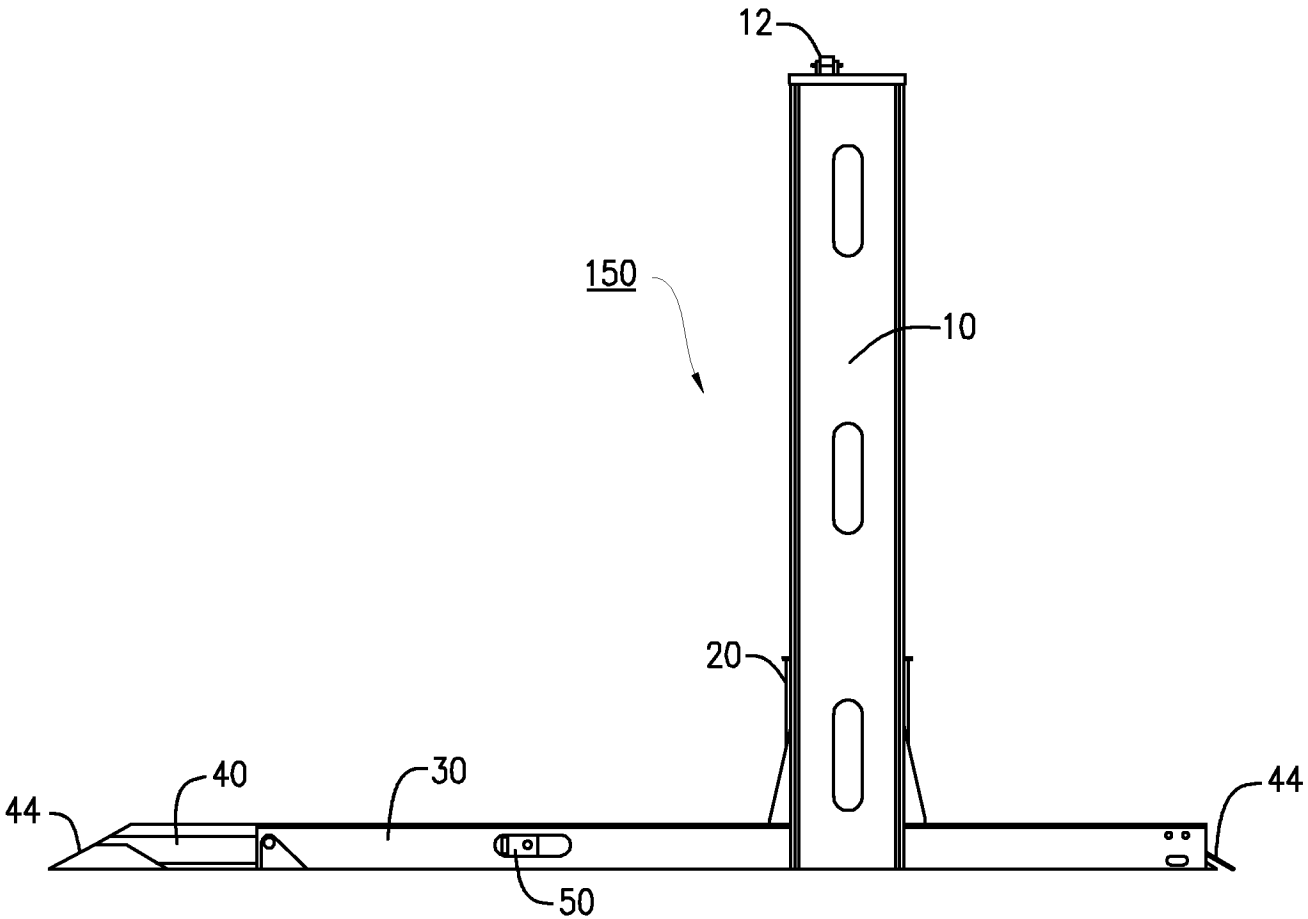
FIG. 2 depicts a side view of a cantilever parking lift assembly in accordance with one aspect of the disclosure.

Referring to FIGS. 1 and 2, a cantilever parking lift apparatus 150 includes columns 10, carriage side plates 20, base 30 and platform 40.

Columns 10 extend from base 30 and are configured to accommodate portions of a lifting subassembly described hereinbelow. Column 10 includes an upper direction changing sheave 12 positioned and operable to engage a lifting chain.

Base 30 is configured to accommodate portions of a lifting subassembly described hereinbelow, including but not limited to actuator 50.

Figure 2B:
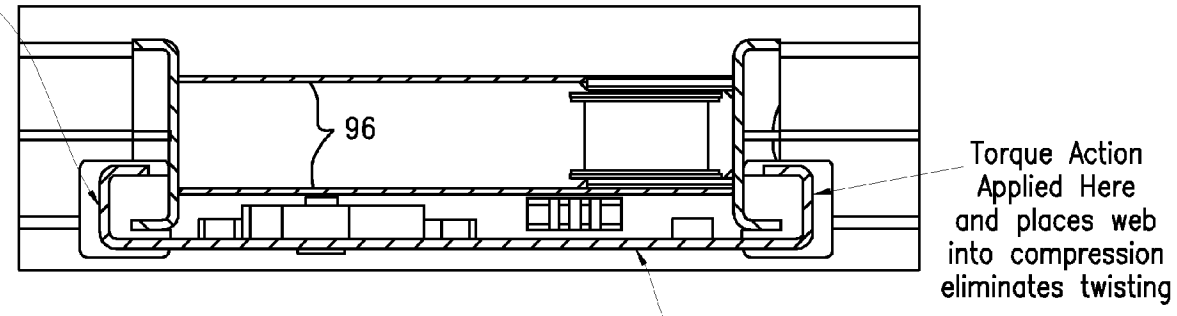
FIG. 2B depicts a view of the parking lift apparatus of FIG. 2A taken along line K-K in accordance with one aspect of the disclosure.
Figure 2A:
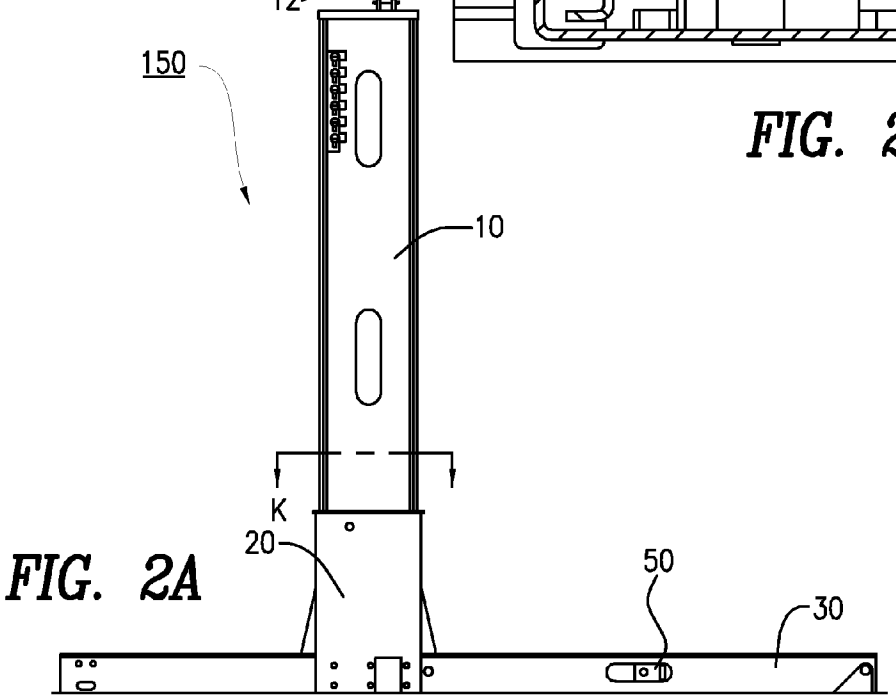
FIG. 2A depicts an opposite side view of the cantilever parking lift assembly of FIG. 2, taken from between the columns.

With further reference to FIGS. 2A and 2B, carriage side plates 20 slidably engage columns 10 and are operable to eliminate twisting of the columns 10 when the platform 40 is raised or lowered. Torque action applied in the indicated regions in section K-K in accordance with this embodiment places the web in compression and eliminates twisting. In the prior art the force placed on the sliding area by the cantilevered load of the platform causes a twisting moment that pivots about the center connecting piece in the column. Using two center connecting pieces that align the front and back sliding areas eliminate any twisting connection, solving the twisting problem of the prior art.

Figure 4:
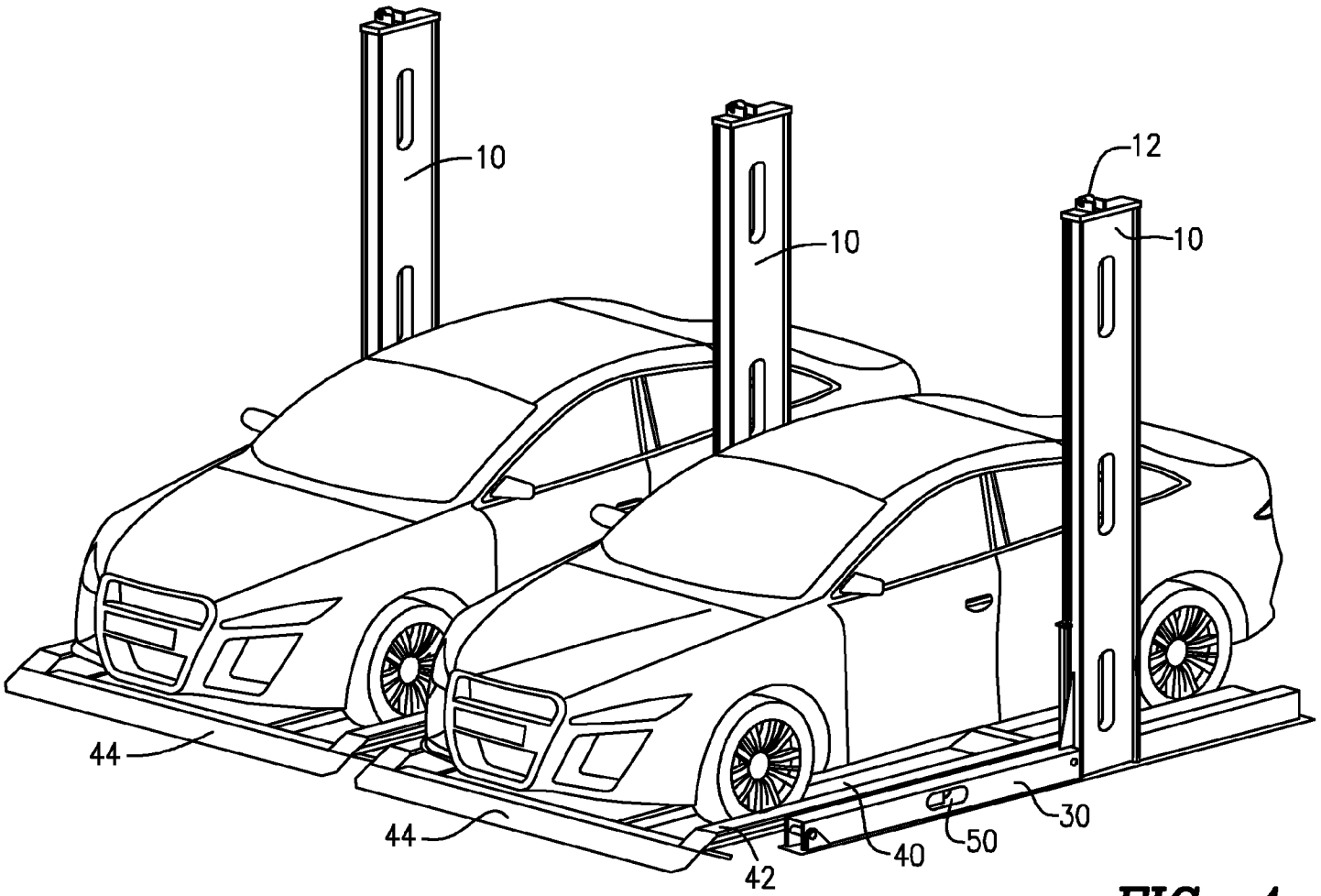
FIG. 4 depicts a perspective view of adjacent cantilever parking lift assemblies with automobiles present in accordance with one aspect of the disclosure.

Referring to FIG. 4, The platform 40 includes curbs 42 and at least one platform ramp 44. Curbs 42 are approximately 4 to about 10 inches, preferably about 6 to about 7 inches, and most preferably 6.5 inches in width, and are dimensioned to have the same or substantially the same height as the top of the base 30, providing a flat surface to walk along.

The curbs 42 on the platform 40 are significantly wider than known parking lift platforms. The platform 40 and the base are therefore easier to walk on when entering and leaving the car than existing parking platforms. The wide curbs 42 act as guides, with the further advantage that they force the driver to center the car on the lift, which reduces the likelihood of damage caused by hitting the rearview mirrors or slamming the doors into the column. The platform 40 is designed and dimensioned as shown so that the car must be centered on the lift and the driver gets tactile feedback from the front and back ramps 44 to signal the driver when the car is positioned correctly.

Figure 3:
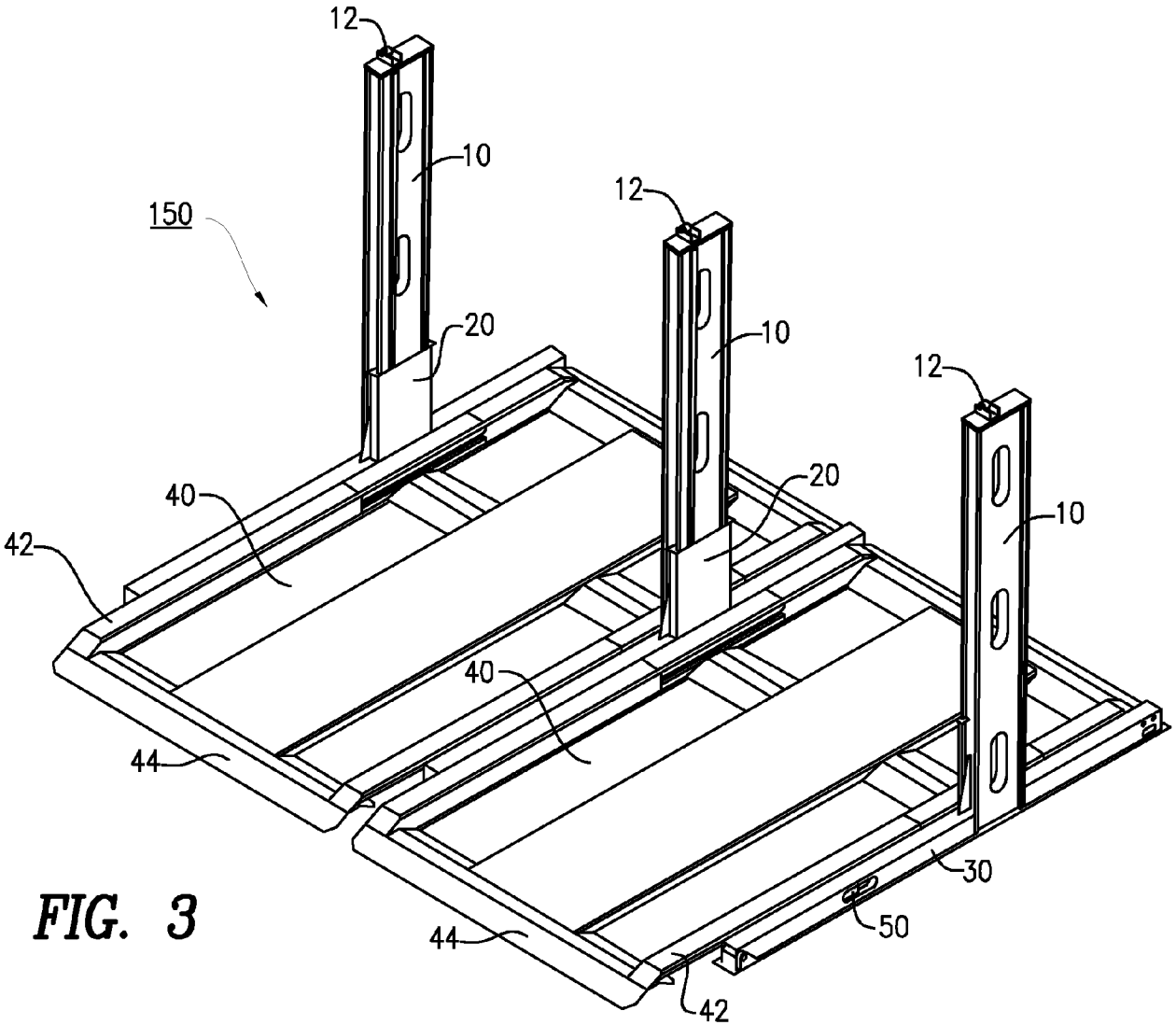
FIG. 3 depicts a side perspective view of adjacent cantilever parking lift assemblies in accordance with one aspect of the disclosure.

Now referring to FIGS. 3 and 4, an embodiment may include adjacent apparatus employing a shared column 10.

Figure 5A:
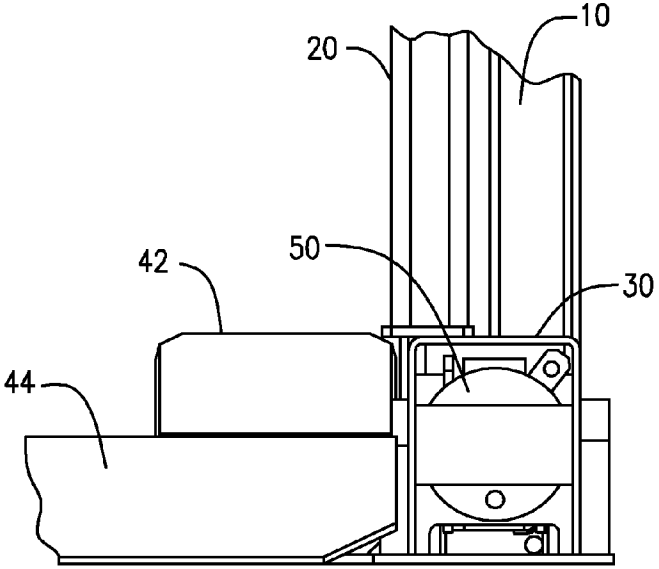
FIG. 5A depicts detail M of a column base portion of the cantilever parking lift assembly of FIG. 5.
Figure 5:
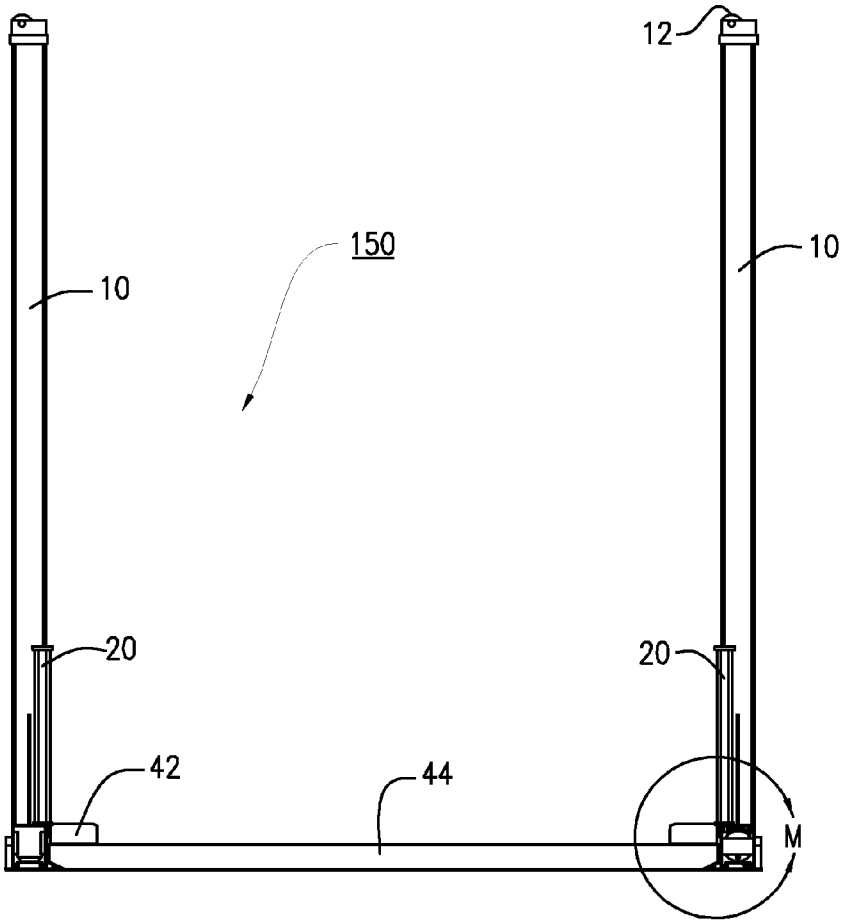
FIG. 5 depicts a front view of a cantilever parking lift assembly in accordance with one aspect of the disclosure.

Now referring to FIG. 5, an actuator 50 may be positioned in base 30. Actuator 50 may be a linear hydraulic motor such as a hydraulic cylinder.

Figure 6A:
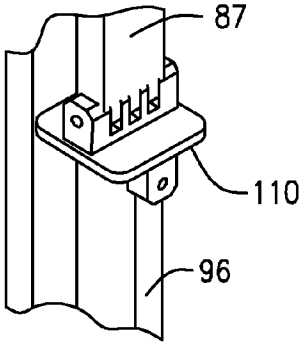
FIG. 6A depicts detail N, a chain differential, of the subassembly of FIG. 6.
Figure 6B:
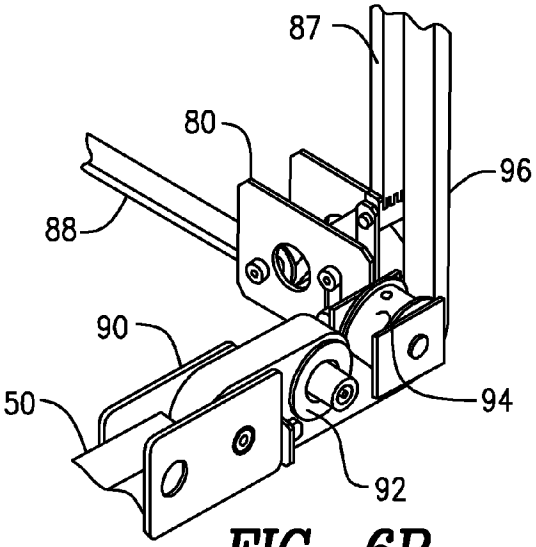
FIG. 6B depicts detail R of the subassembly of FIG. 6.
Figure 6:
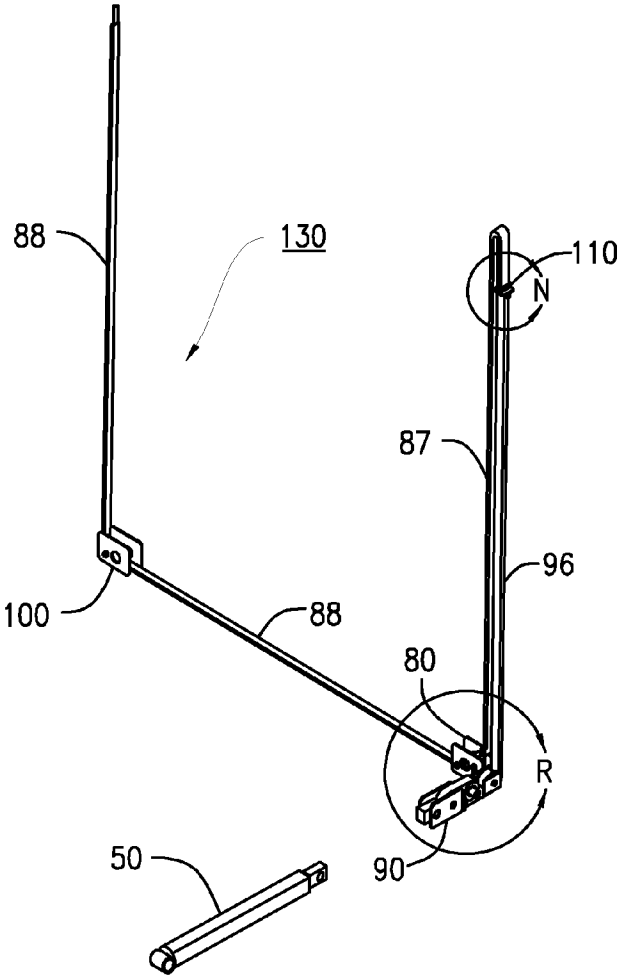
FIG. 6 depicts a perspective view of a lift apparatus subassembly of a cantilever parking lift assembly in accordance with one aspect of the disclosure.

Now referring further to FIG. 6, a lift mechanism subassembly 130 includes a dynamic cross chain sheave assembly 80, a block assembly 90, a static cross chain sheave assembly 100, lifting chain 87, cross chain 88 and power chain 96. With further reference to FIG. 6A, in one embodiment lifting chain 87 and power chain 96 are connected via differential 110. One skilled in the art will recognize belts, webs, cables or wire ropes may be used in lieu of chains. One skilled in the art will further recognize that in embodiments in which the lifting chain 87 is a wire rope, cable or the like a differential 100 is not necessary, and lifting chain 87 may serve as a power chain and lifting chain.

The lift mechanism subassembly is preferably housed at least in part within the base 30 and columns 10, with cross chain 88 positioned beneath and extending transversely across platform 40. Actuator 50 is optimally housed within the base and the various chain elements 87, 88 and 96 are housed at least in part in the columns 10 as shown and described. An advantage of placing the actuator 50 in the base 30 rather than in or around the columns 10 is that the lifting column 10 can be made very narrow because it has no actuator in or around it. As shown in FIG. 3, by virtue of this arrangement, adjacent platforms 40 may be disposed closer together than in prior art arrangements. Now referring to FIG. 4, the platforms of FIG. 3 may accommodate adjacent vehicles closer together than is possible in the prior art, which have actuators such as hydraulic cylinders) mounted in and around the vertical part of the column. The narrow column 10 increases the drive-through space when the lifts are centered on a normal parking stall. Lifts placed in a commercial parking facility are normally placed on the same centers as the original parking spaces or parking spaces that were not designed for lifts. When this is done the width of the columns reduce the available width of the parking space. It is therefore desirable to keep the columns as narrow as possible.

It will be recognized that this embodiment also keeps the actuator 50 and all the moving parts associated therewith enclosed in the base 30 where they are out of sight and do not restrict the available width of the parking space. Existing cantilever lifts employ cylinders mounted in and around the vertical part of the column. To raise the platform the required amount, without requiring the cylinders to extend well above the parking lift in the fully raised position, it is necessary to use a lifting ratio multiplier in the form of a set of pulleys, levers or gears, or a telescoping hydraulic cylinder. The pulleys, levers and gears mounted in or around the vertical part of the column are unsightly, dirty and dangerous and add to the overall width of the column. The telescoping cylinder has a problem of changing speed as the different sections are used. Situating the actuator in the base, as disclosed herein, along with the necessary mechanical lifting ratio multiplier and all the hydraulic tubing, valves, and electrical connectors allows the column 10 and base 30 to be completely assembled at the factory, including the mechanical, hydraulic and electrical components, and to fully test it is operational before it is packaged and shipped. Enclosing the actuator and associated mechanical and electrical components protects them from tampering, rain and weather. It also makes the installation much faster and simpler.

Figure 7:
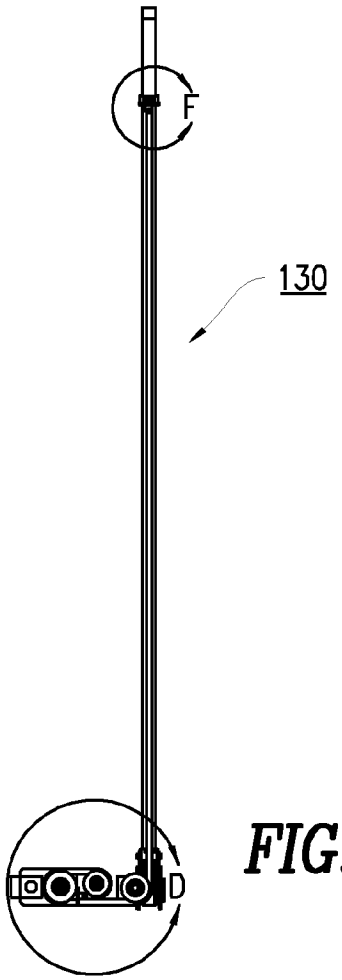
FIG. 7 depicts a side view of a lift apparatus subassembly of a cantilever parking lift assembly in accordance with one aspect of the disclosure.
Figure 7A:
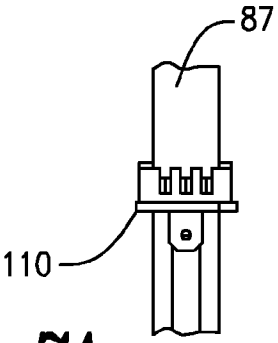
FIG. 7A depicts detail F of the subassembly according to FIG. 7.
Figure 7B:
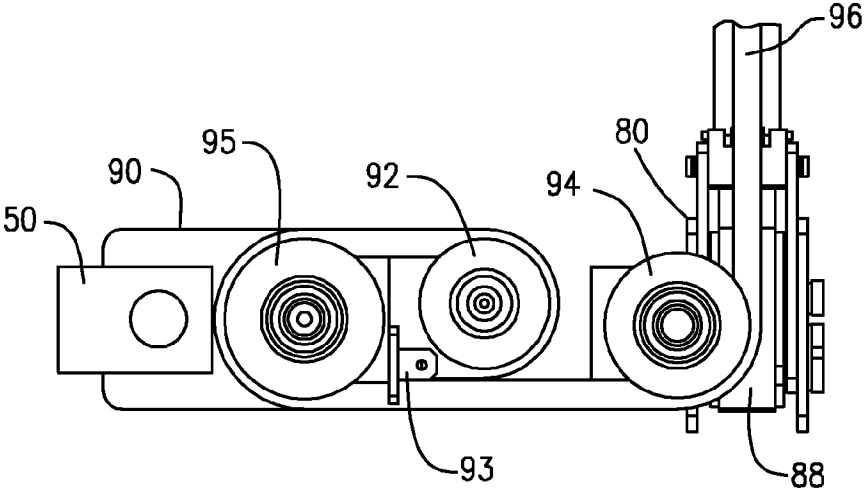
FIG. 7B depicts detail D of the subassembly according to FIG. 7.
Figure 8A:
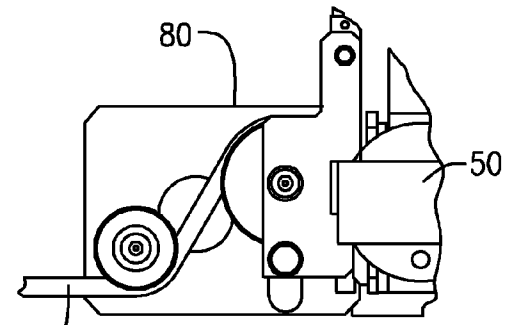
FIG. 8A depicts detail B of the subassembly according to FIG. 8.
Figure 8:
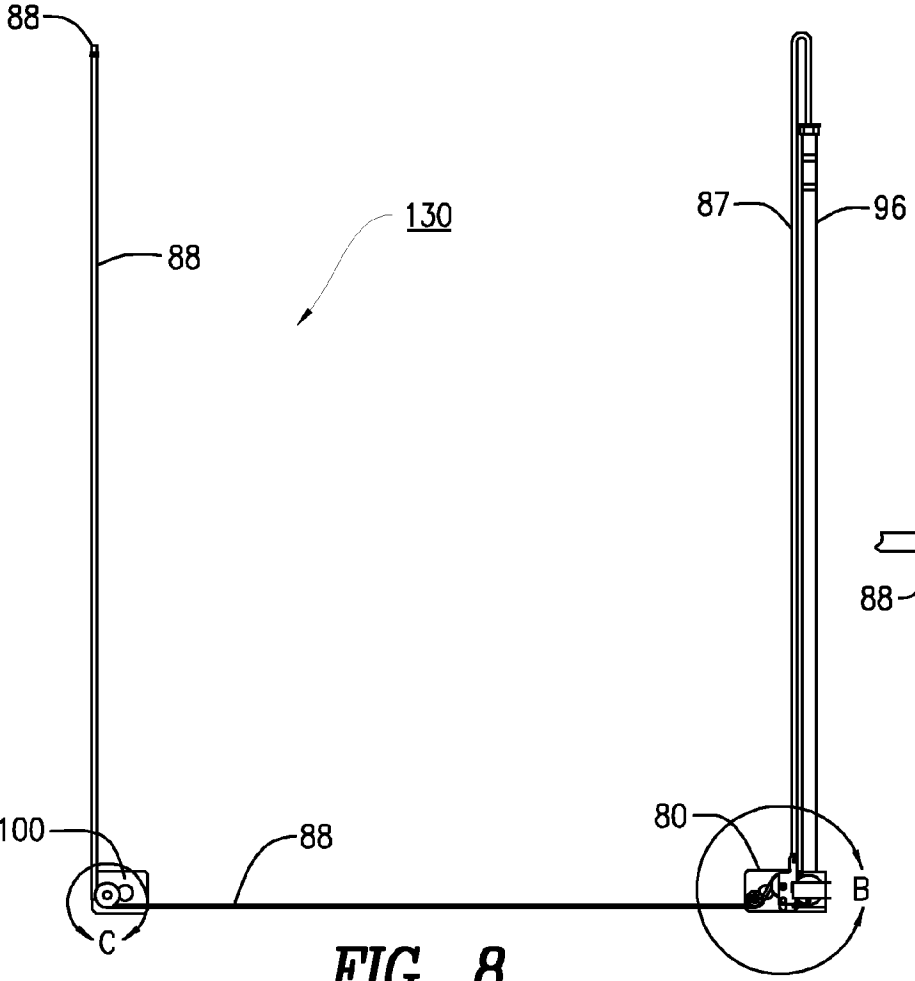
FIG. 8 depicts a front view of a lift mechanism subassembly of a cantilever parking lift assembly in accordance with one aspect of the disclosure.

With further reference to FIGS. 6B, 7 and 7B, block assembly 90 includes multiplier sheave 92, block chain anchor 93, lower direction changing sheave 94 and block sheave 95. Actuator 50 is operably connectable to block assembly 90. Power chain 96 is anchored to block chain anchor 93, fed around multiplier sheave 92, block sheave 95 and lower direction changing sheave 94 and terminates at chain differential 110, which is connected to lifting chain 87. With further reference to FIGS. 8, 8A and 9, lifting chain 87 is fed over upper direction changing sheave 12 (see FIG. 1) and is connected to dynamic cross chain sheave assembly 80.

In one embodiment, chain is used because it permits much smaller roller sizes to be used than is possible with wire rope or cable. The smaller rollers permit reduction of the size of the base 30. However, mounting the actuator 50 in this manner in the base 30 requires a direction change for the lifting chain 87. The power chain 96, connected via block assembly 90 to the actuator 50, and the multiplier sheaves require that the chain be allowed to flex or bend in the front to back direction of the apparatus. The lifting chain 87 that goes over roller 94 at the top of the column 10 and then extends down to connect to the dynamic cross chain sheave assembly 80 must flex or bend in the side to side direction of the lift apparatus. Because it is not possible for a single-leaf chain to flex or bend in both directions, the power chain 96 and lifting chain 87 chains are connected, using a differential 110 as shown in FIG. 7A, so that the chains 96 and 87 are disposed at a 90° angle relative to one another. This arrangement is unique in car lifts.

Placement of the actuator, block assembly 90 and ratio multiplier in the base, which contacts the ground, has the added benefit of placing less lifting stress on the vertical portion of the column which allows it to be made thinner and of lighter weight material. Additionally, the actuator 50 can be configured to work on either side of the lift to accommodate left-hand or right-hand drive cars.

In one embodiment, actuator 50 is a mechanical actuator such as a hydraulic cylinder and is disposed horizontally in base 30, having one end fixed to base 30 and an opposite end fixed to block assembly 90. Actuation of cylinder 50 provides motive force to lifting chain 87 through block assembly 90.

Employing assembly 130, the platform 40 is raised from one side only via lifting chain 87. The other side of the platform is raised by the interaction of the dynamic cross chain sheave assembly 80, static cross chain sheave assembly 100 and cross chain 88, as described further hereinbelow.

Figures 9A, 9B:
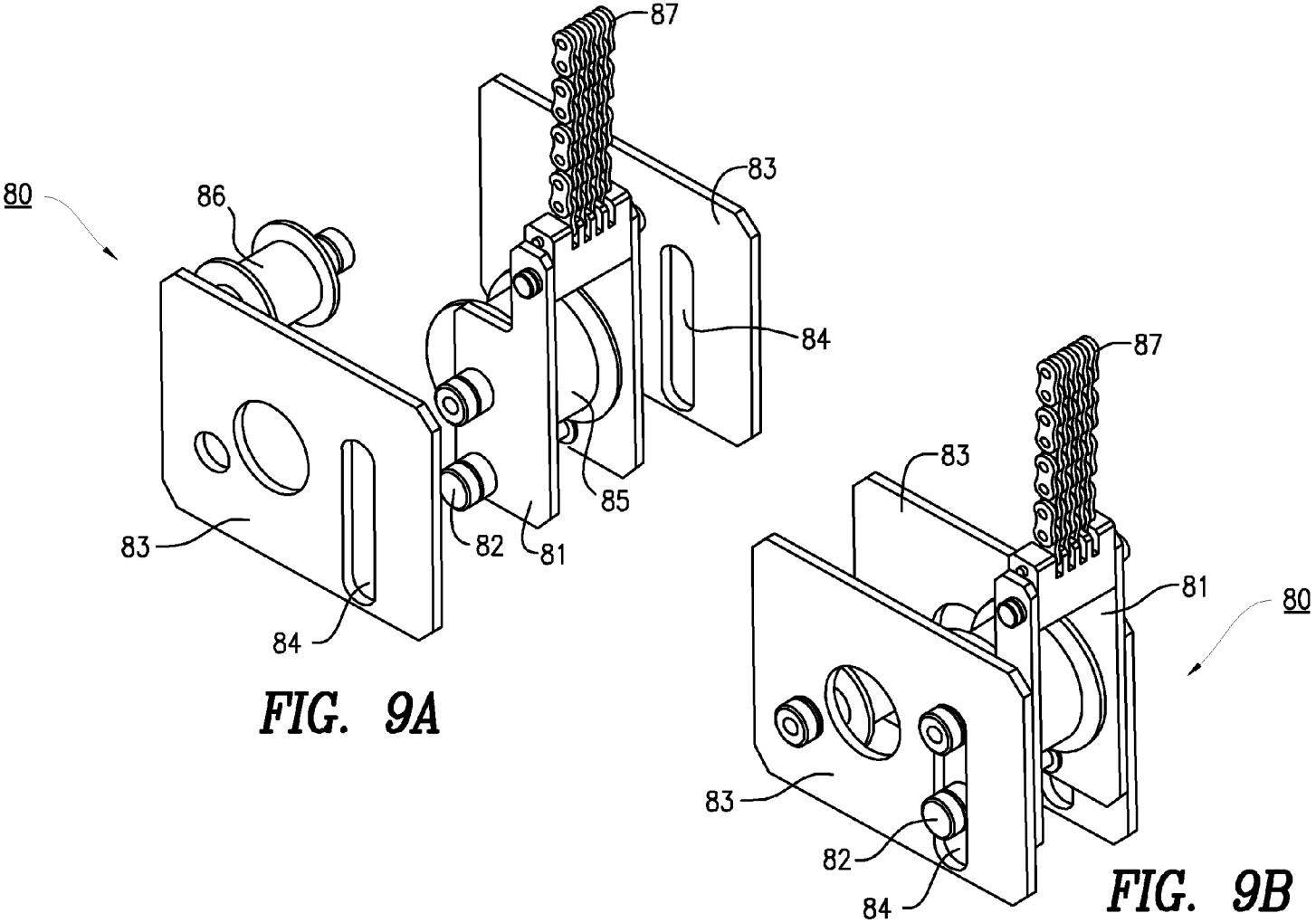
FIG. 9A depicts an exploded perspective view of a dynamic cross chain sheave assembly in accordance with one aspect of the disclosure.
FIG. 9B depicts a perspective view of a dynamic cross chain sheave assembly in accordance with one aspect of the disclosure.

With further reference to FIGS. 9A-9B, in one embodiment dynamic cross chain sheave assembly 80 includes essentially sliding sheave assembly 81, plates 83 and sheave 86. Sliding sheave assembly includes sheave 85 and pin 82. Sliding sheave assembly 81 is connected at one end to lifting chain 87 and pin 82 is slidably engaged with slots 84 of plates 83.

Figure 8B:
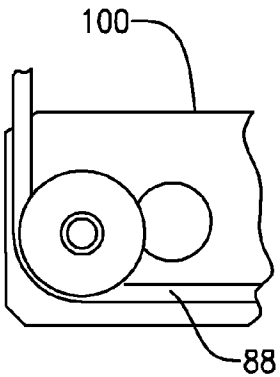
FIG. 8B depicts detail C of the subassembly according to FIG. 8.
Figure 10A:
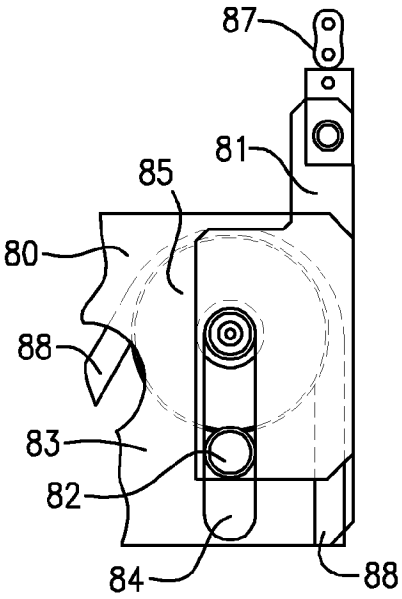
FIG. 10A depicts detail U of FIG. 10.
Figure 10:
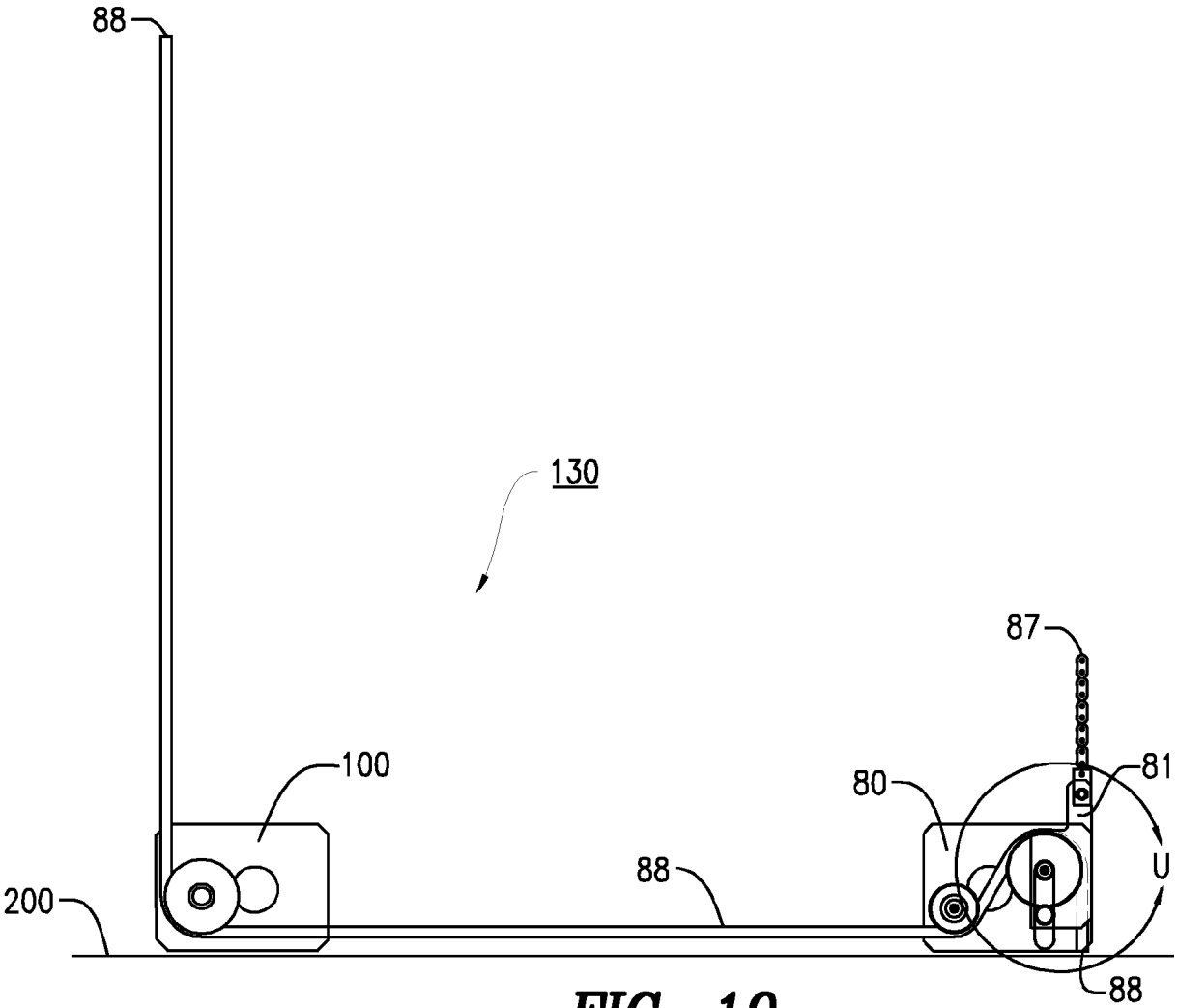
FIG. 10 depicts a front view of a cross chain and sheave assemblies of a lift mechanism subassembly assembly demonstrating a typical condition when the platform is parked on a level surface in accordance with one aspect of the disclosure.

With reference to FIG. 10, cross chain 88 is anchored to base 30 and fed through dynamic cross chain sheave assembly 80, across and under platform 40 (not shown) to static cross chain sheave assembly 100 and anchored at or near the top of an opposite column 10. As shown in FIG. 8B static cross chain sheave assembly 100 includes a sheave and bracket and serves to guide cross chain 88 as dynamic cross chain sheave assembly 80 rises and descends. Now referring to FIG. 10A, in one embodiment, dynamic cross chain sheave assembly 80 includes sliding sheave assembly 81 including a pin 82 slidably engaged in slot 84. Sliding sheave assembly 81 is operable to move in slot 84 until pin 82 contacts plate 83. In the embodiment shown in FIG. 10, in which the lifting apparatus is in the "down" position on a level ground surface 200, sliding sheave assembly 81 does not move downward because no slack is required in the cross chain 88 in such position.

Figure 11A:
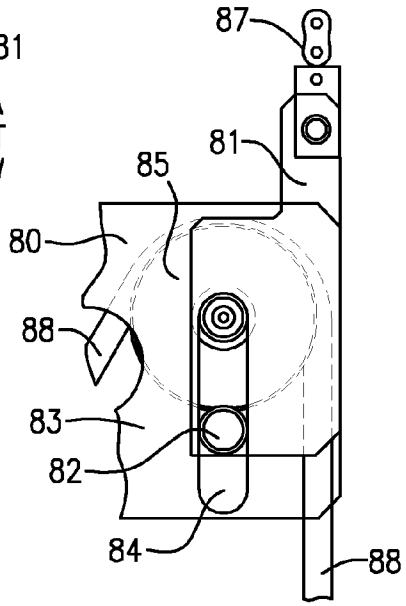
FIG. 11A depicts detail T of FIG. 11.
Figure 11:
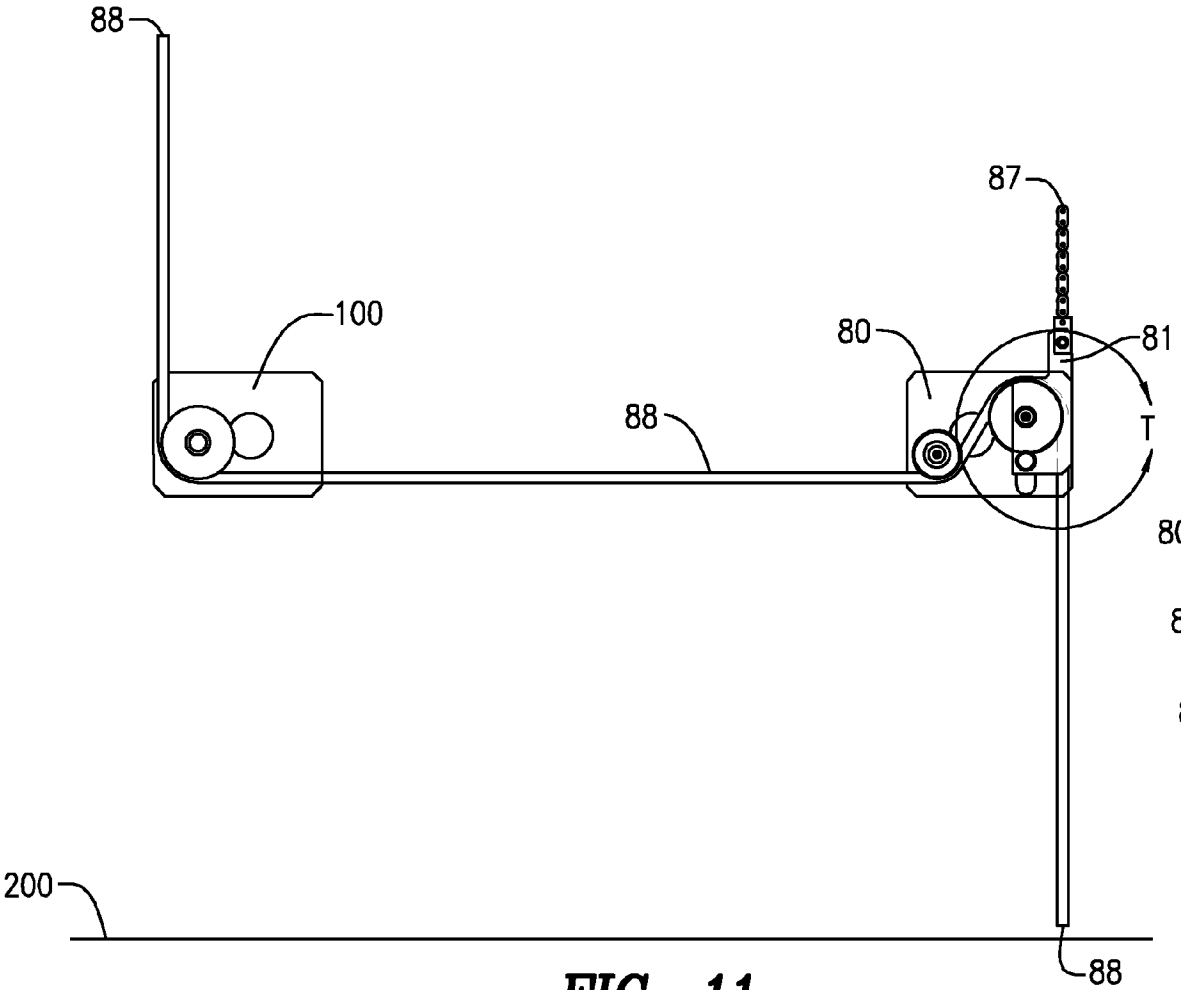
FIG. 11 depicts a front view of a cross chain and sheave assemblies of a lift mechanism subassembly demonstrating a typical condition when the platform is raised in the air in accordance with one aspect of the disclosure.

Now referring to FIG. 11, which depicts a raised position of the cross chain assembly, and a level ground surface 200, lifting chain 87 is operable to raise dynamic cross chain sheave assembly 80 and by virtue of cross chain 88 being anchored at one end to base 30 and at the other end at or near the top of an opposite column 10, static cross chain sheave assembly 100 is also raised. Now referring to FIG. 11A, in this embodiment, sliding sheave assembly 81 is operable to travel upward in slot 84 until pin 82 contacts plate 83. While not shown, it will be apparent to the skilled artisan that the platform 40 is raised as sheave assemblies 80 and 100 are raised.

Figure 12A:
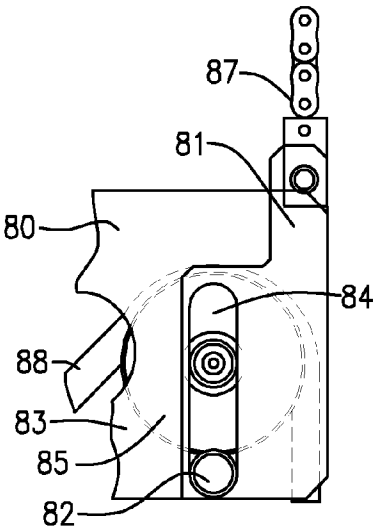
FIG. 12A depicts detail V of FIG. 12.
Figure 12:
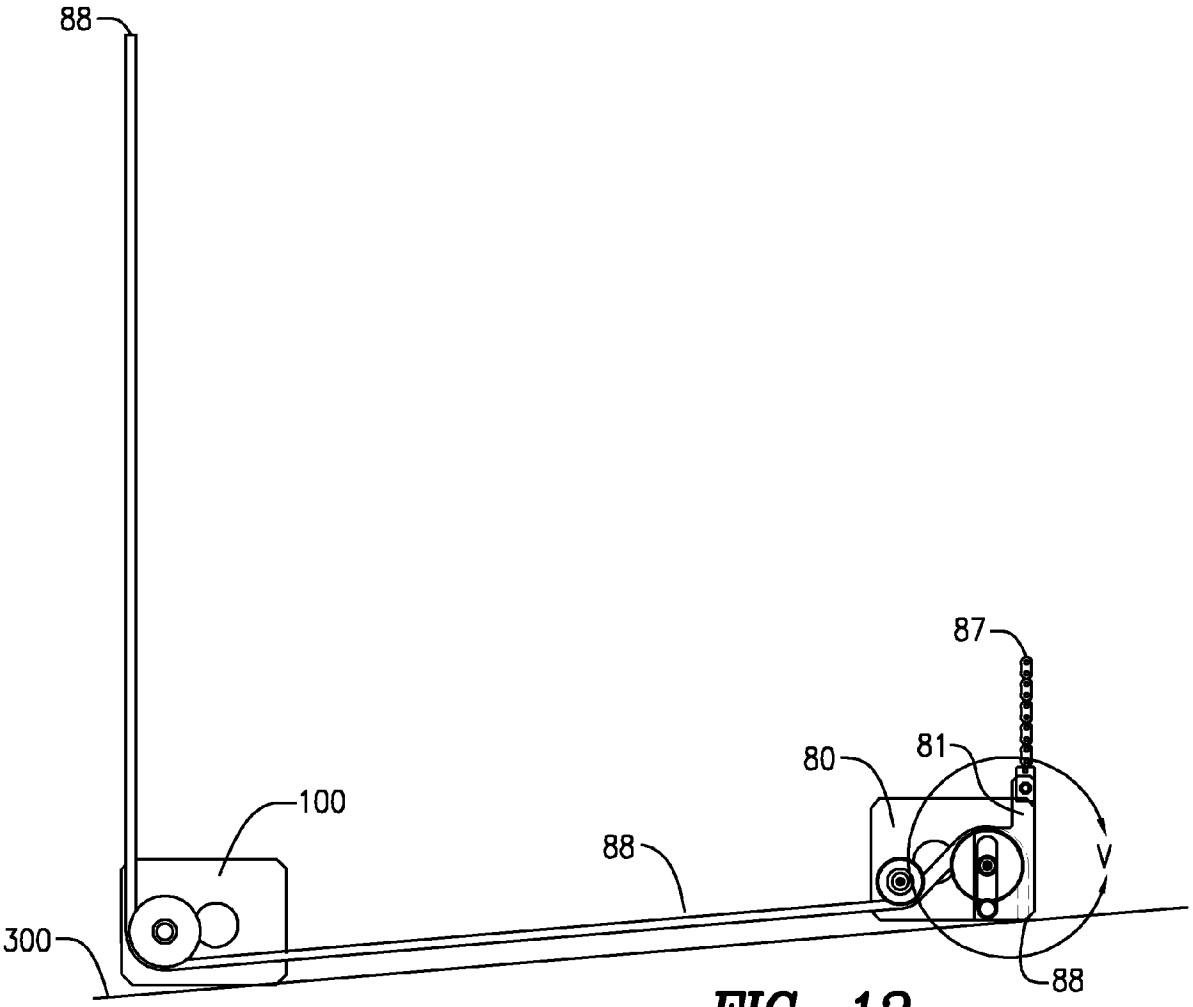
FIG. 12 depicts a front view of a cross chain and sheave assemblies of a lift mechanism subassembly demonstrating the ability of the disclosed apparatus to park a platform on an unlevel surface in accordance with one aspect of the disclosure.

Now referring to FIG. 12, an embodiment is shown in which the ground surface 300 is not level. Now referring to FIG. 12A, sliding sheave assembly 81 is configured to be pulled down because additional slack is needed in the cross chain 88 so that the static cross sheave assembly may make contact with the surface 300.

In prior art lift systems employing a cross chain system, a problem arises if the platform is adjusted to be level in the raised position, when the terrain is sloped, from side to side, whereby the lifting side is the higher of the two sides. As the platform is lowered to the ground, once the lifting side touches the ground the opposite side cannot go any further. This causes the platform to be raised above the ground on the opposite side. In the other condition, when the lifting side is lower than the opposite side, and the opposite side touches first, there is not a problem because the cross chain will just go slack as the lifting side is lowered further than the opposite side. In this case the platform will sit flat on the ground.

However, the problems of the prior art are solved by the presently disclosed apparatus by configuring the cross chain roller 85 on the lifting side in a sliding sheave assembly 81. Using the sliding sheave assembly 81, the lifting side is permitted to touch the ground first but the cross chain roller 85 can continue downward until the opposite side of the platform 40 touches the ground. This means that the platform 40 will sit flat on the ground no matter which side is higher. This is a significant advantage in parking lots which often have a sloping drive aisle with parking spaces on either side of it. On one side of the aisle the lifting side of the lifts is the lower side and on the other side of the aisle the lifting side of the lifts is the higher side, causing one row of platforms to be slightly off the ground on one side. The presently disclosed apparatus permit the platform 40 to always lay flat on the ground, regardless of the slope of the surface, allowing cars to drive across the platforms.

Although preferred embodiments of the invention have been disclosed for an illustrative purpose, those skilled in the art would appreciate that many additions, modifications, and substitutions are possible without departing from the scope and spirit of the invention.

What is claimed is:

1. A cantilever parking lift system operable to be positioned on a surface comprising:

a vertically movable parking platform, first and second bases positionable on the surface, first and second columns extending vertically from the first and second bases, respectively, wherein the platform is positioned between the bases and columns;

a lift mechanism comprising a vertically movable dynamic cross chain sheave assembly positioned adjacent the first column, a vertically movable static cross chain sheave assembly positioned adjacent the second column, a cross chain extending from the first base and functionally engaged with the dynamic cross chain sheave assembly and static cross chain sheave assembly and anchored at one end proximate a top portion of the second column, a lifting chain extending from the dynamic cross chain sheave assembly to an upper direction changing sheave proximate a top portion of the first column and to a lower direction changing sheave of a block assembly proximate a bottom of the first column, wherein the block assembly is housed in the first base, wherein the block assembly is movable along a length of the first base and operable to raise the dynamic cross chain sheave assembly, and wherein the cross chain extends beneath and transversely across the platform, and wherein when the lift mechanism is activated, the lifting chain is operable to raise the platform from one side only, and an opposite side of the platform is raised by interaction of the dynamic cross chain sheave assembly, static cross chain assembly and cross chain.

2. The cantilever parking lift system of claim 1 further comprising an actuator positioned only in the first base and operably connected to the block assembly.

3. The cantilever parking lift system of claim 2 wherein the actuator is a hydraulic cylinder.

4. The cantilever parking lift system of claim 1 wherein the lifting chain comprises a differential connected to a power chain extending from the block assembly.

5. The cantilever parking lift assembly of claim 4 wherein the block assembly comprises a multiplier sheave, a block chain anchor, the lower direction changing sheave and block sheave, wherein the power chain is anchored to the block chain anchor, fed around the multiplier sheave, block sheave and the lower direction changing sheave and terminates at the differential.

6. The cantilever parking lift assembly of claim 1 further comprising a first carriage side plate slidably engaged to the first column and a second carriage side plate slidably engaged to the second column.

7. The cantilever parking lift assembly of claim 1 wherein the block assembly comprises a multiplier sheave, a block chain anchor, the lower direction changing sheave and block sheave, wherein the lifting chain is anchored to the block chain anchor, fed around the multiplier sheave, block sheave and the lower direction changing sheave.

8. The cantilever parking lift assembly of claim 1 wherein the dynamic cross chain sheave assembly comprises a sliding sheave assembly comprising a sheave comprising pins extending from sides of the sheave, and plates comprising slots for slidably retaining the pins.

9. The cantilever parking lift assembly of claim 1 wherein the static cross chain sheave assembly comprises a sheave and bracket operable to guide the cross chain as the dynamic cross chain sheave assembly rises and descends.

10. The cantilever parking lift assembly of claim 1 wherein the platform comprises curbs extending along opposite sides of the platform perpendicular to an entrance end of the platform.

11. The cantilever parking system according to claim 10 wherein the curbs are approximately 4 to about 10 inches in width.

12. The cantilever parking system according to claim 10 wherein the curbs are approximately 6 to 7 inches in width.

13. The cantilever parking system according to claim 10 wherein the curbs are approximately 6.5 inches in width.

14. The cantilever parking system according to claim 10 wherein the curbs are dimensioned to have the same height as the first and second bases.

15. The cantilever parking system according to claim 1 wherein the platform comprises a ridge extending transversely across the platform parallel to an entrance end of the platform.

16. The cantilever parking system according to claim 1 wherein the platform comprises a ramp proximate an entrance end of the platform, the ramp comprising a front slope extending upward from the edge of the platform entrance and a rear slope extending downwardly toward an opposite end of the platform.

17. The cantilever parking system according to claim 16 wherein the platform comprises two entrance ends, one at each end of the platform.

* * * * *